US008365360B2

(12) United States Patent
Kunnath et al.

(10) Patent No.: US 8,365,360 B2
(45) Date of Patent: Feb. 5, 2013

(54) REMOVABLE HANDLE

(76) Inventors: Dana Louise Kunnath, Bloomfield Hills, MI (US); Glenn Kunnath, Bloomfield Hills, MI (US)

( * ) Notice: Subject to any disclaimer, the term of this patent is extended or adjusted under 35 U.S.C. 154(b) by 417 days.

(21) Appl. No.: 12/536,528

(22) Filed: Aug. 6, 2009

(65) Prior Publication Data

US 2010/0146738 A1 Jun. 17, 2010

Related U.S. Application Data

(63) Continuation-in-part of application No. 12/335,580, filed on Dec. 16, 2008, now abandoned.

(51) Int. Cl.
*A47B 95/02* (2006.01)

(52) U.S. Cl. ..... 16/415; 16/406; 16/413; 16/422; 16/DIG. 7

(58) Field of Classification Search ..... 16/405–406, 16/412–413, 415, 422, 430, DIG. 7, DIG. 25, 16/DIG. 41, DIG. 42
See application file for complete search history.

(56) References Cited

U.S. PATENT DOCUMENTS

| | | | | | |
|---|---|---|---|---|---|
| 2,606,733 | A | * | 8/1952 | Krajewski | 248/215 |
| 3,089,211 | A | * | 5/1963 | Perusse | 24/556 |
| 3,107,389 | A | * | 10/1963 | Engelbrecht | 16/416 |
| 3,261,633 | A | * | 7/1966 | Sakuta | 294/16 |
| RE29,979 | E | * | 5/1979 | Guebert et al. | 160/330 |
| 4,153,097 | A | * | 5/1979 | Pettibone | 160/330 |
| D254,417 | S | * | 3/1980 | DeMars et al. | D7/622 |
| 4,213,492 | A | * | 7/1980 | Guebert et al. | 160/124 |
| 4,237,958 | A | * | 12/1980 | Guebert et al. | 160/330 |
| D290,931 | S | * | 7/1987 | Powell | D8/373 |
| 4,947,526 | A | * | 8/1990 | Fogelman | 24/336 |
| D318,608 | S | * | 7/1991 | Schenker | D8/382 |
| D326,021 | S | * | 5/1992 | Evenson | D6/323 |
| 5,384,938 | A | * | 1/1995 | Frederick | 24/306 |
| 5,535,971 | A | * | 7/1996 | Adams | 248/215 |
| 5,788,298 | A | * | 8/1998 | Cheng | 294/27.1 |
| 6,588,064 | B2 | * | 7/2003 | Baum | 16/422 |
| 6,658,701 | B1 | * | 12/2003 | DeHart et al. | 16/425 |
| 7,040,726 | B2 | | 5/2006 | Steffee | |
| 7,185,864 | B2 | * | 3/2007 | Adams | 248/301 |
| 7,207,088 | B2 | * | 4/2007 | Adams et al. | 16/413 |
| D584,939 | S | * | 1/2009 | Snell | D8/367 |
| D595,560 | S | * | 7/2009 | Miska | D8/314 |
| D620,779 | S | * | 8/2010 | Kunnath et al. | D8/314 |
| D628,052 | S | * | 11/2010 | Carl | D8/367 |
| 2003/0213094 | A1 | | 11/2003 | Wills | |
| 2004/0187265 | A1 | * | 9/2004 | Ho | 16/422 |
| 2004/0261226 | A1 | * | 12/2004 | Moody | 16/413 |
| 2008/0127458 | A1 | * | 6/2008 | Ramsauer | 16/412 |

OTHER PUBLICATIONS

Advertisement for "TAPENIX"; Fast Cap® 2009 catolog.
Copending U.S. Appl. No. 12/335,580, filed Dec. 16, 2008.

* cited by examiner

*Primary Examiner* — Roberta Delisle
(74) *Attorney, Agent, or Firm* — Dobrusin & Thennisch PC

(57) ABSTRACT

A handle for opening and closing any door or drawer of a commercial or residential building is disclosed. The handle includes a first wall member joined to a second wall member that is attached to a third wall member to form a removable handle for opening and closing a door or drawer. At least one wall member is flexible and resilient such that when the handle is attached to a door or drawer, the first wall member flexibly and resiliently moves to form a self-tensioning, self-grip in conjunction with the remaining wall members on the door or drawer allowing the handle to be used to open and/or close a door or drawer.

14 Claims, 8 Drawing Sheets

REMOVABLE HANDLE

CLAIM OF PRIORITY

The present application claims priority to U.S. application Ser. No. 12/335,580 filed on Dec. 16, 2008, the contents of which are incorporated by reference for all purposes.

FIELD OF THE INVENTION

The present invention relates generally to handles, and more particularly to removable door and drawer handles for opening and closing cabinet doors, cabinet drawers, interior doors, entry/exit doors and/or otherwise for commercial and residential uses.

BACKGROUND OF THE INVENTION

Cabinet doors, cabinet drawers, interior doors, entry/exit doors and/or otherwise are often manufactured without handles for purposes of allowing the purchaser the ability to select custom handles according to their desired taste. Therefore, it is likely that a purchaser may install and begin to use any doors, drawers, and/or otherwise without installing their respected handles. This may pose a problem for purchasers and builders who wish to make use of cabinet doors, cabinet drawers, interior doors, entry/exit doors and/or otherwise post installation but prior to attachment of any handle or other device allowing for use of the drawer or door. Prior to handle installation it may be extremely challenging to open and shut any door or drawer without damaging the door or drawer.

To remedy this issue, handles can be attached by adhesives. For example, one part of a door handle generally protrudes outwardly from the door for grasping and pulling open or closing the door, while the adhesive portion of the handle is adhesively bonded to a surface of the door. The adhesive attaching may minimize the possibility of marring the door, which is a concern by many cabinet owners when the handles are attached via fasteners, however, the adhesive attachment of the handle can be messy and may leave an adhesive residue on the surface of the cabinets, cabinet drawers, interior doors, entry/exit doors and/or otherwise once the handle is removed. Thus, there is a need for a removable handle that attaches to cabinet doors, cabinet drawers, interior doors, entry/exit doors and/or otherwise without the downsides of using adhesive as well as the damage and difficulty that may arise from the use of common fasteners (e.g. nails, screws, staples).

The invention solves this problem by providing a removable handle permitting the purchaser to easily install the removable handle without the use of additional tools such as screw drivers, drills, and the like or having to use adhesives, screws, nails, staples, or otherwise. Until the purchaser decides on permanent handles, the removable handles of this invention can aid the owner in the opening and closing of the cabinet doors, cabinet drawers, interior doors, entry/exit doors and/or otherwise. Alternatively, if the purchaser does not desire to purchase permanent handles, the removable handles may be utilized permanently to aid in the opening and closing of the cabinet doors, cabinet drawers, interior doors, entry/exit doors and/or otherwise.

SUMMARY OF THE INVENTION

The present invention meets some or all of the above-mentioned needs by providing a removable handle for opening and/or closing a door or drawer.

One aspect of the invention is directed towards a handle for opening and closing a door or drawer comprising: a first wall member having a curved c-shape so that the first wall member can be grasped during installation, removal, and use; a second wall member integral formed and extending from the first wall member, such that the second wall member intersects the first wall member at a location on the handle where the curvature of the first wall member ends; and a third wall member integrally formed with and extending substantially perpendicular from the second wall member so that the third wall member is located on the inside of a door or drawer during use and is of sufficient length to maintain the handle in a fixed location during use. The second and third wall members further comprise an outer surface opposite and parallel to an inner surface, and the second and third wall members are substantially planar in shape and extend generally downward from the second wall member. At least one wall member is generally flexible and resilient such that when the handle is attached to a door or a drawer the at least one wall member flexibly and resilient moves to form a self-grip in conjunction with the remaining wall members on a door or a drawer.

This aspect of the invention may be further characterized by one or any combination of the following: the second wall member includes a portion that extends toward the third wall member and a portion that extends away from the third wall member; the portion of the second wall member that extends away from the third wall member includes a tab that may be grasped during installation, removal and use of the handle; the handle does not fasten to a door or a drawer by an adhesive, screw, nail, or staple.

In another aspect, the present invention contemplates a method for opening a door or drawer having no installed handle comprising: providing a removable handle having a first wall member, a second wall member, and a third wall member; providing a curved c-shape portion as the first wall member integrally formed with and extending from the second wall member; grasping the c-shape portion; placing the handle onto an edge of a door or drawer such that a grip is formed between the first wall member, the second wall member, and the tab portion and maneuvering the door or drawer to a desired position.

This aspect of the invention may be further characterized by one or any combination of the following: the method does not include a step of fastening the handle to a door or a drawer via an adhesive, screw, nail, or staple; the handle is removed after the door or drawer is placed in the desired location; the handle is not removed after the door or drawer is placed in the desired location; the first wall portion is shaped to allow for grasping and pulling on the handle while preventing disengagement of the handle during use; the handle is adjustable to allow for doors and drawers of varying thicknesses; the handle includes: a first wall member having a curved c-shape so that the first wall member can be grasped during installation, removal, and use; a second wall member integral formed and extending from the first wall member, such that the second wall member intersects the first wall member at a location on the handle where the curvature of the first wall member ends; and a third wall member integrally formed with and extending substantially perpendicular from the second wall member so that the third wall member is located on the inside of a door or drawer during use and is of sufficient length to maintain the handle in a fixed location during use. The second and third wall members further comprise an outer surface opposite and parallel to an inner surface, and the second and third wall members are substantially planar in shape and extend generally downward from the second wall member. At least one wall member is generally flexible and resilient such that when the handle is attached to a door or a drawer the at least one wall member flexibly and resilient moves to form a self-grip in conjunction with the remaining wall members on a door or a drawer.

It should be appreciated that the above referenced aspects and examples are non-limiting as others exist with the present invention, as shown and described herein. For example, any of the above mentioned aspects or features of the invention may be combined to form other unique configurations of the finished block, as described herein, demonstrated in the drawings, or otherwise.

BRIEF DESCRIPTION OF THE DRAWINGS

The features of the present invention shall become clear to those skilled in the art upon reading the attached detailed description along with reference to the following drawings, in which.

DETAILED DESCRIPTION

Figure 1:
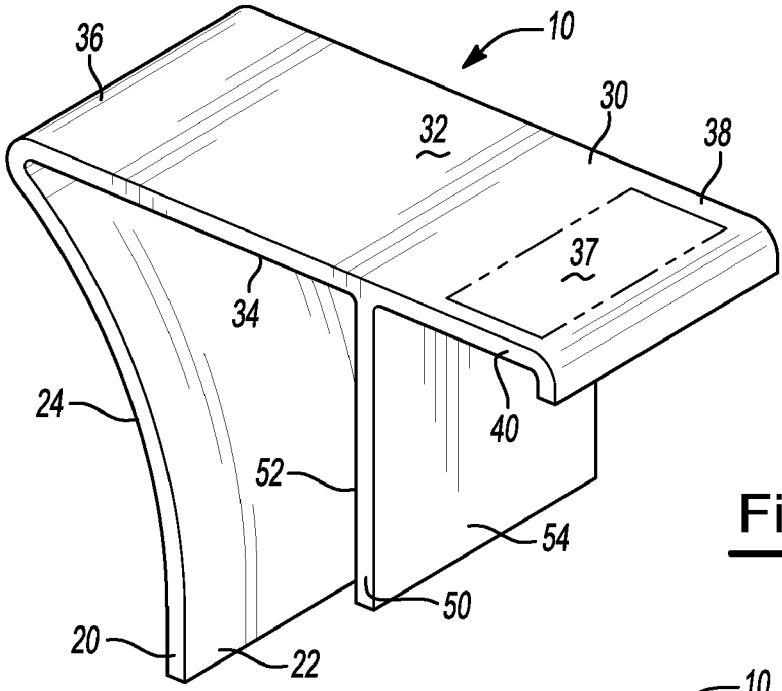
FIG. 1 is a perspective view of an embodiment of the handle in accordance with the present invention.
Figure 2:
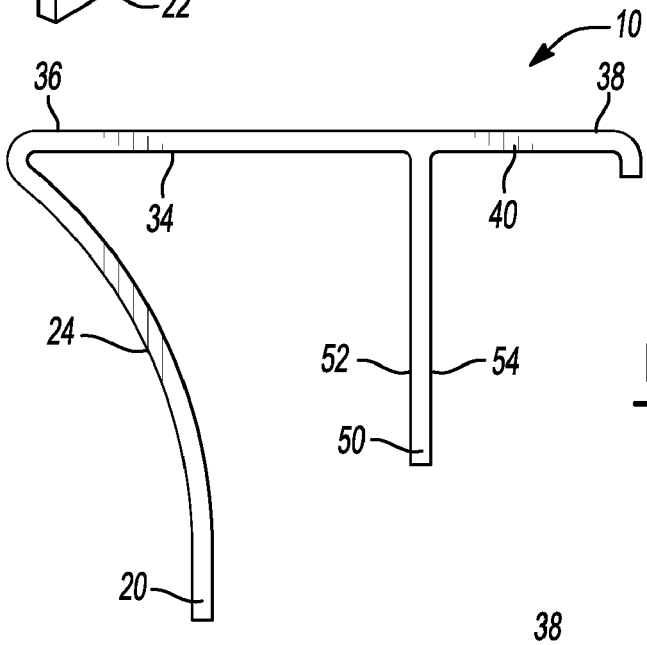
FIG. 2 is a side view of the handle from FIG. 1.
Figure 3:
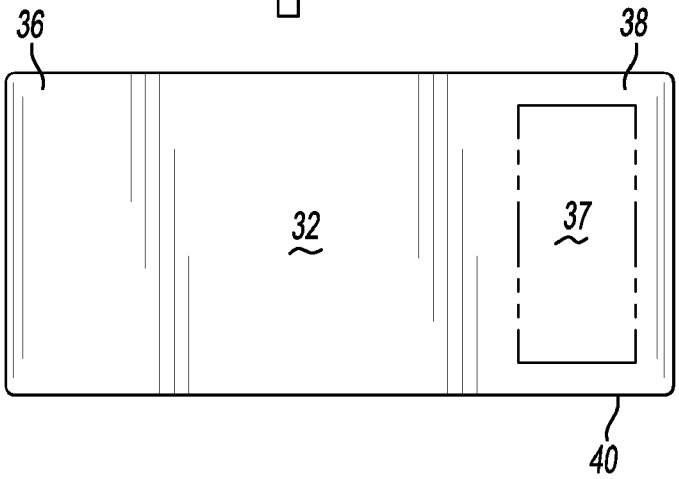
FIG. 3 is a top view of the handle from FIG. 1.
Figure 4:
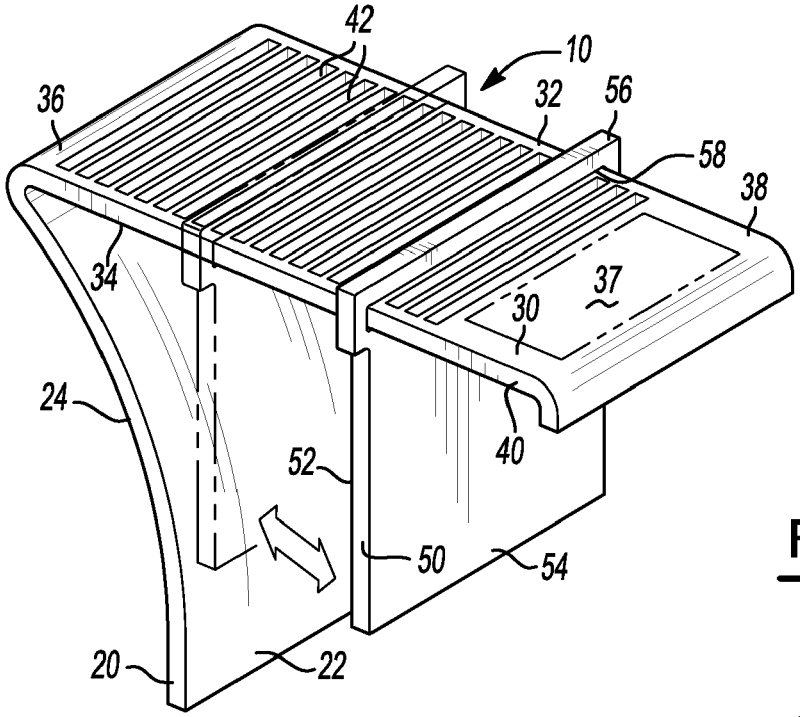
FIG. 4 is a perspective view of an embodiment of the handle in accordance with the present invention.
Figure 5:
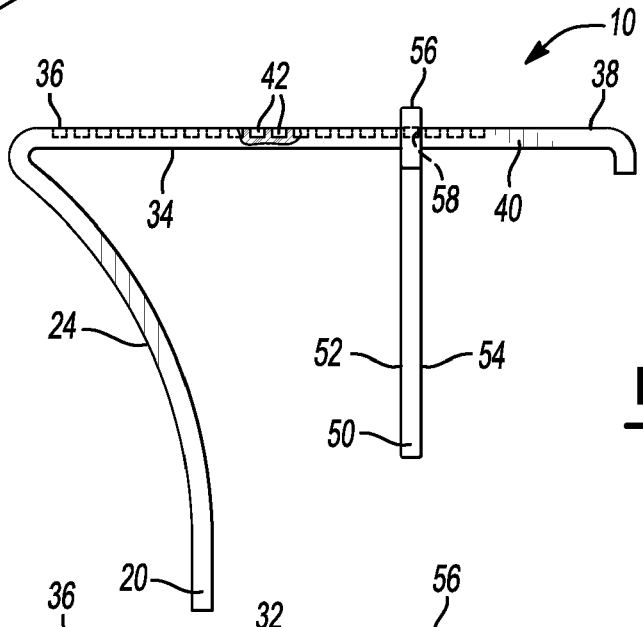
FIG. 5 is a side view of the handle from FIG. 4.
Figure 6:
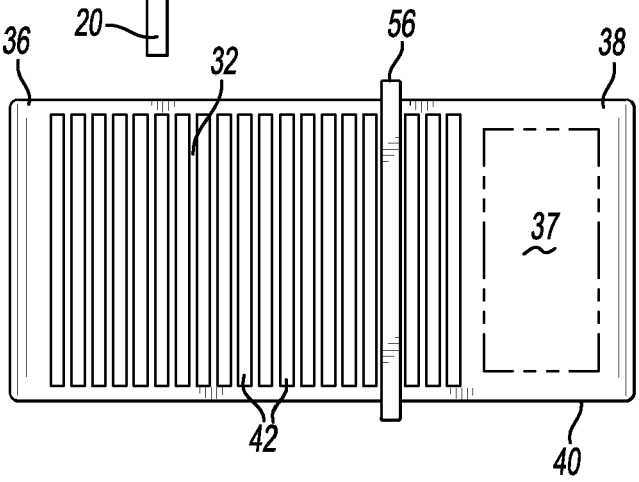
FIG. 6 is a top view of the handle from FIG. 4.

Referring to FIGS. 1 and 4, a handle 10 is shown in accordance with the present invention. As shown, the handle includes a first wall member 20, a second wall member 30, and a third wall member 50. It should be appreciated by one skilled in the art that the handle 10 may be made from a soft touch plastic that is non-marring, a rigid rubber that is non-marring, a metal composite that is non-marring, or otherwise.

Figure 7:
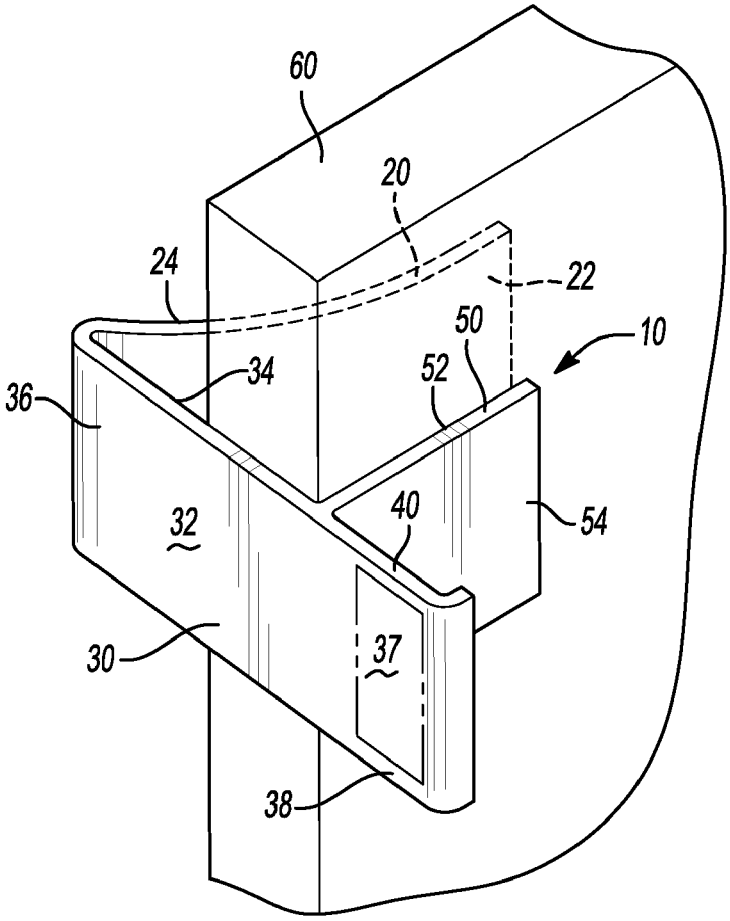
FIG. 7 is an illustration of the embodiments of the handle from FIG. 1 attached to a cabinet door.
Figure 8:
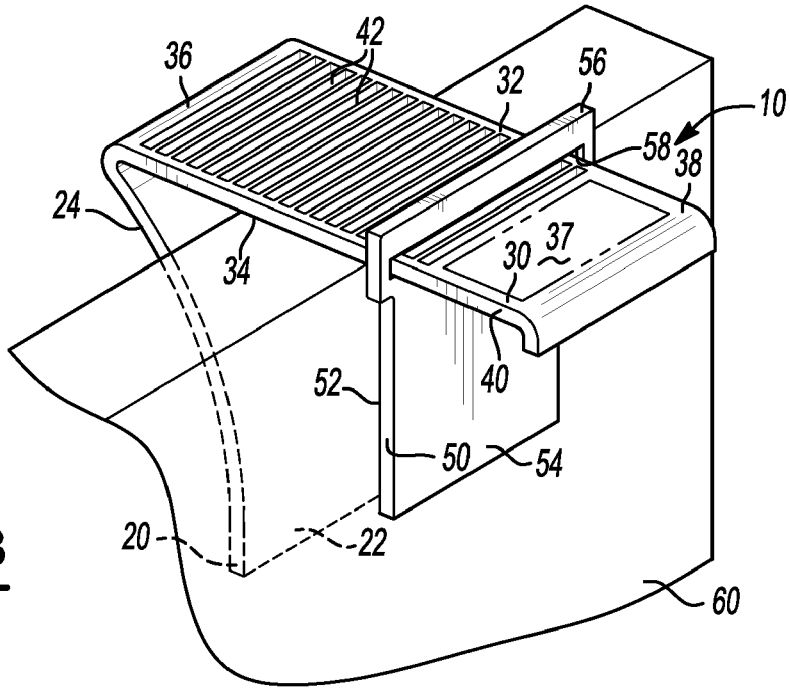
FIG. 8 is an illustration of the embodiments of the handle from FIG. 4 attached to a cabinet door.

The first wall member 20 includes an inner surface 22, and an outer surface 24. The first wall member 20 is flexible and resilient allowing movement of the first wall member 20 in relation to the third wall member 50. This allows the distance between the first wall member 20 and the third wall member 50 to increase at certain points when the handle 10 is attached to a cabinet door 60 as shown in FIGS. 7 and 8. The flexibility of the first wall member 20 allows the member 20 to move such that a grip is formed between the first, second and third wall members 20, 30, 50, respectively, and the periphery of the cabinet door 60. The resilience of the first wall member causes the first wall member 20 and the third wall member 50 to apply opposing forces on the periphery of the cabinet door 60 attaching the handle to the door. As shown in FIG. 1, the handle 10 may be pre-tensioned to allow expansion from the range of about ¼ to 3 inches, ⅜ inch to 1 and ¼ inch, or otherwise which is particularly useful with standard doors produced with ¾ inch peripheries as well as custom made doors ranging up to about 1 and ¼ inch of thickness. The first wall member 20 may be curved in a bow shape as shown in FIGS. 1 and 4. The curvature of the first wall member 20 facilities installation of the handle and provides resilience for securing the handle to the door.

The handle 10 further may include a second wall member 30 having an outer surface 32, an inner surface 34, a first end 36, and a second end 38. The second wall member 30 is substantially planar in shape, and is integrally formed and joined to the first wall member 20. The second wall member 30 may further include a tab 40 that protrudes from the second end 38 for grasping, and maneuvering the cabinet door 60 open or closed. It should be appreciated by one skilled in the art, that the substantially planar shape of the second wall member 30 may also contain indicia (e.g. manufacturer name etc.) on the outer surface 32 of the second wall member 30 as shown in FIGS. 7 and 8 (the indicia may be placed at 37). The indicia shown is located on the second end 38 but it should be appreciated by one skilled in the art that the indicia be placed anywhere on the outer surface 32, and not limited to placement on the second end 38. The handle 10 may be produced with an insert mold, which allows the mold to be changed as desired to input different forms of indicia on the handle 10. Alternatively, an adhesive label encompassing indicia may also be utilized in order to label the handle 10 with various forms of indicia. It should be appreciated by one skilled in the art that the indicia may be a company name, logo, decorative pattern, and/or otherwise.

The handle 10 further includes a third wall member 50. The third wall member 50 may be generally perpendicular to the second wall member 30. The third wall member 50 may also be generally parallel to the first wall member 20. The third wall member 50 may be integrally formed and joined to the second wall member 30.

Referring to FIGS. 4, 5, 6 and 8 another embodiment of the temporary cabinet door handle 10 is shown. For convenience, common reference numerals have been utilized for common components in this embodiment and the embodiment shown in FIG. 1. In this embodiment, the second wall member 30 may further includes ridges 42 that extend in a column from the first end 36 to the second end 38. The ridges 42 can be but are not necessarily equally spaced apart from one another and generally parallel to one another. The ridges 42 permit the handle 10 to be adjustable to fit various door 60 thicknesses by allowing the handle 10 to be adjustable. The multiple adjustment feature of the handle 10 in FIG. 4 allows the handle 10 to be adjustably expandable to grip various peripheries of doors 60 and drawers having a periphery in the range from about ¼ to 6 inches, ⅝ to 2 and ¾ inches, or otherwise.

In FIG. 4, the third wall member 50 may be removable attached to the second wall member 30 as shown in FIG. 4 and may include an integrally formed head 56 defining a bore 58 for receiving the second wall member 30. The head 56 fits and may matingly engage into any one of the ridges 42 on the second wall member 30 for allowing the third wall member 50 to be slideably adjustable between the first and second ends 36, 38, respectively, and self-locking with the second wall member 30.

Referring to FIGS. 7 and 8, in operation the handle 10 is removably attached to a door 60. More particularly, the inner surface 22 of the first wall member 20, the inner surface 34 of the second wall member 30, and the inner surface 52 of the third wall member 50 may contact various surfaces of the door 60 when the handle 10 is tension fit and attached to the door 60. For instance, upon application of the handle 10 to the door 60, the inner surface 22 may contact the back surface of the door 60. The other inner surface 34 may contact the intermediate surface of the door 60 and the other inner surface 52 may contact the front surface of the door 60 such that the wall members 20, 30 and 50 form a self grip with the door 60. As shown in the drawings, the handle 10 is attached to a door 60 of a cabinet, but it should be appreciated by one skilled in the art that the temporary handle 10 may also be utilized on cabinets, cabinet drawers, interior doors, entry/exit doors and/or otherwise.

Figure 9A:
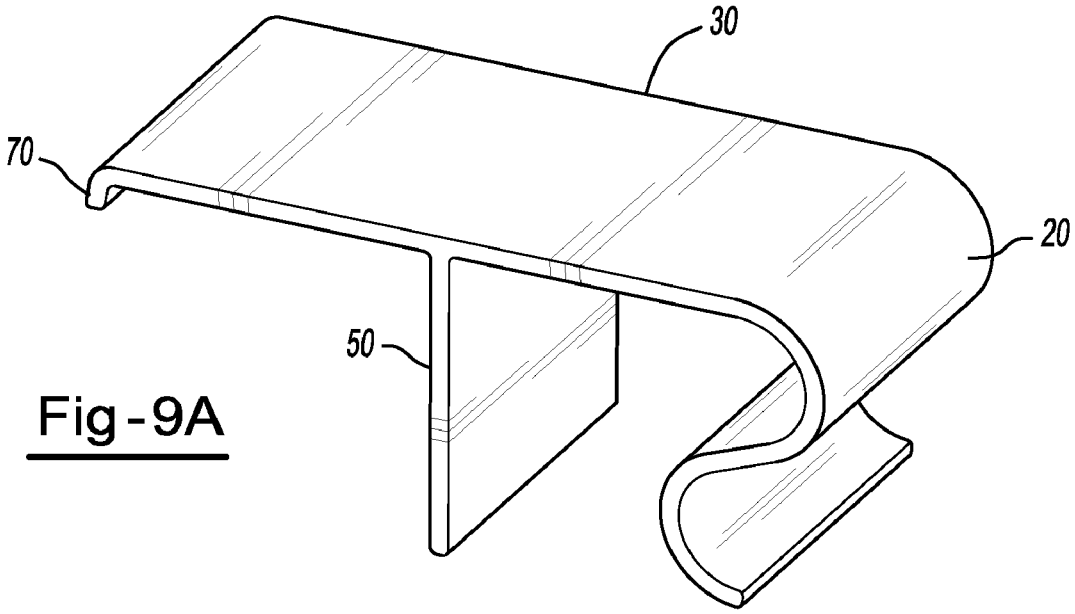
FIG. 9A is a perspective view of an embodiment of the handle in accordance with the present invention.
Figure 9B:
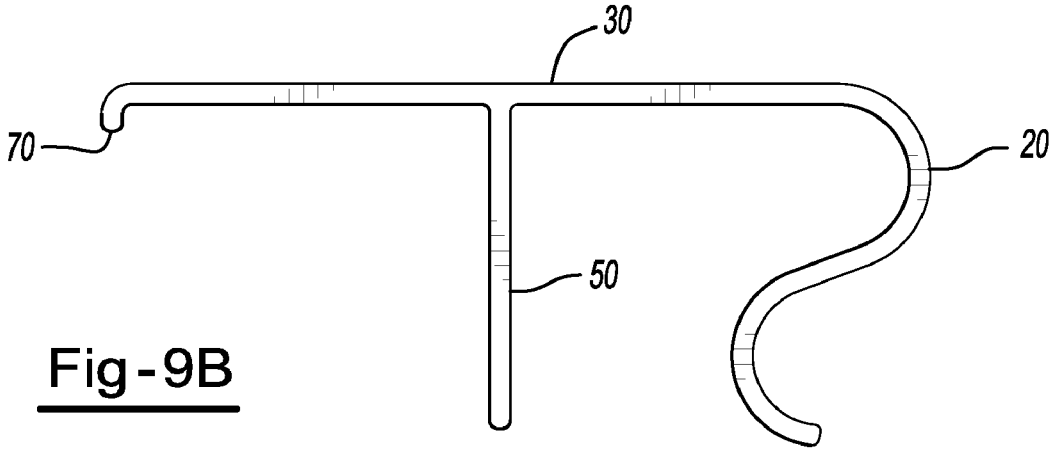
FIG. 9B is a profile view of the handle from FIG. 9A.
Figure 9C:
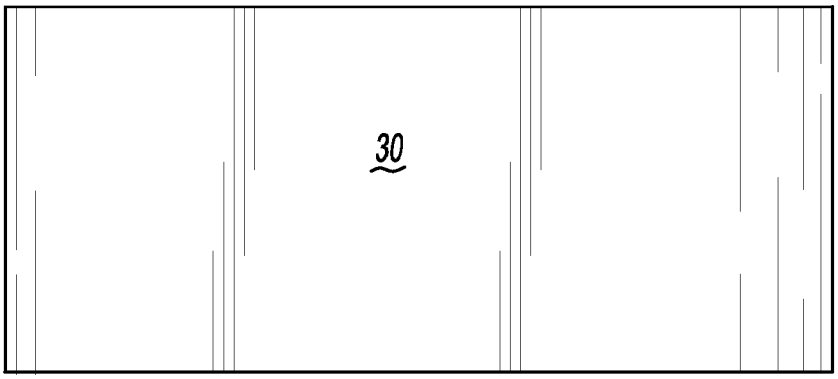
FIG. 9C is a top view of the handle from FIG. 9A.
Figure 10A:
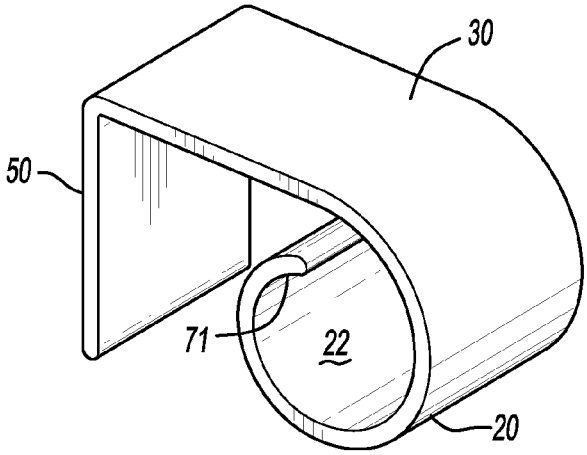
FIG. 10A is a perspective view of an embodiment of the handle in accordance with the present invention.
Figure 10B:
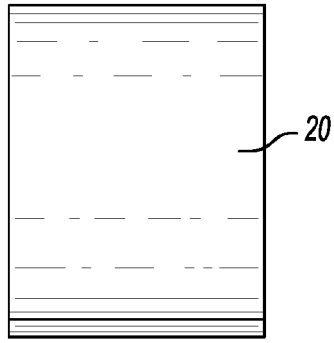
FIG. 10B is a front view of the handle from FIG. 10A.
Figure 10C:
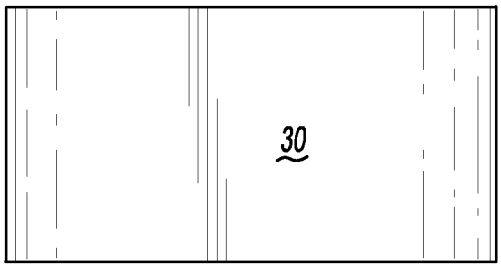
FIG. 10C is a top view of the handle from FIG. 10A.
Figure 10D:
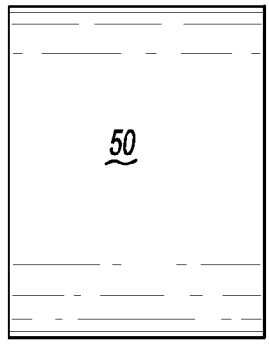
FIG. 10D is a back view of the handle from FIG. 10A.
Figure 10E:
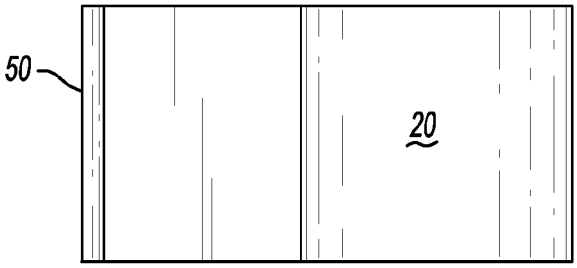
FIG. 10E is a bottom view of the handle from FIG. 10A.
Figure 10F:
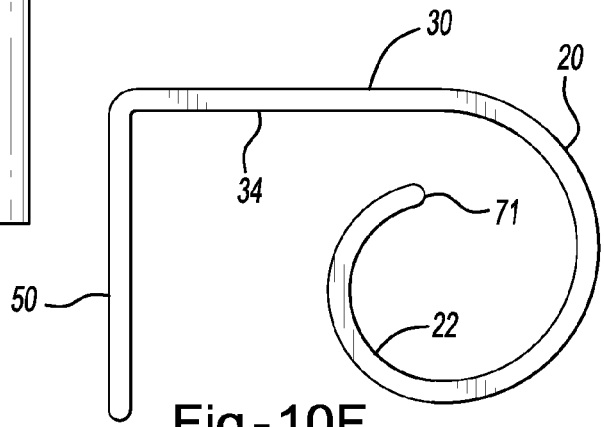
FIG. 10F is a profile view of the handle from FIG. 10A.

As shown (for example) in FIGS. 9A-9C, the first wall member 20 may be curved in a serpentine manner. The second wall member 30 may intersect with the third wall member 50 in a substantially perpendicular arrangement. The second wall member 30 may intersect with the third wall member 50 in a substantially non-perpendicular arrangement. The second wall member 30 may extend beyond any location where the second wall member 30 intersects the third wall member 50, so that the terminating end 70 of the second wall member 30 may be used as a location for grasping the handle during use. Alternatively, the serpentine shape of the first wall member 20 may serve as a location for grasping the handle during use. The third wall member 50 may also serve as a location for grasping during use. Consequently, the first wall 20 or the third wall 50 may be located upon the outside of a drawer or door when the handle is in use. The second wall member 30 may also terminate upon intersection with the third wall 50.

Referring to FIGS. 10A-10F, the first wall member 20 may be curved in a circular arrangement where the terminating end 71 of the first wall member may or may not contact the inner surface 22 of the first wall member or inner surface 34 of the second wall member. The radius of curvature of the first wall member 20 may be constant along the first wall member or may change along the first wall member. The curved surface of the first wall member 20, may give way to a flat surface that becomes the second wall member 30. The second wall member 30 may begin at any point along the surface of the handle where the first wall member 20 is no longer curving. The second wall member 30 may also adjoin a third wall member 50. The third wall member 50 may be attached to the second wall member 30 in a perpendicular arrangement. The third wall member may also be attached to the second wall member at an oblique angle (e.g., at any non-perpendicular arrangement).

During use, the handle may be attached to a drawer, door, or other generally planar surface requiring a movement aid so that the curved first wall member 20 is located where it can be grasped during use of the handle. The terminating end 71 of the first wall member may be in contact with the door, drawer, or other surface. The handle may also be shaped so that the terminating end 71 of the first wall member is not in contact with the door, drawer, or other surface. The first wall member may be in contact with a door, drawer, or other surface at any point prior to the terminating end of the first wall member. The location on the first wall surface at which a door, drawer or other surface contacts the first wall surface may be determinative of how flexible the first wall member may be once in use.

The first wall member 20 may be flexible and resilient allowing movement of the first wall member 20 in relation to the third wall member 50. The third wall member 50 may be flexible and resilient allowing movement of the third wall member 50 in relation to the first wall member 20. Both the first and third wall members may be flexible and resilient to allow for the handle to fit a grasp a wide range of door, drawer, or other surface widths. Only one of the first or third wall members may be flexible and resilient so that the handle is rigid enough to prevent unwanted slippage about or off of a door, drawer or other surface. The second wall member may also be flexible and resilient to allow for further expansion of the handle.

Figure 11:
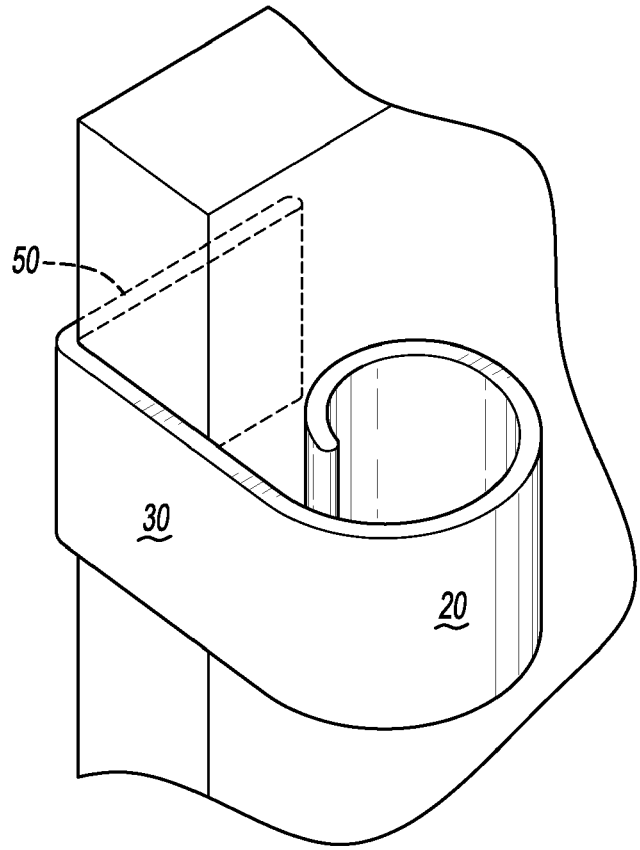
FIG. 11 is an illustration of the embodiment of the handle from FIGS. 10A-10F attached to a drawer.
Figure 12:
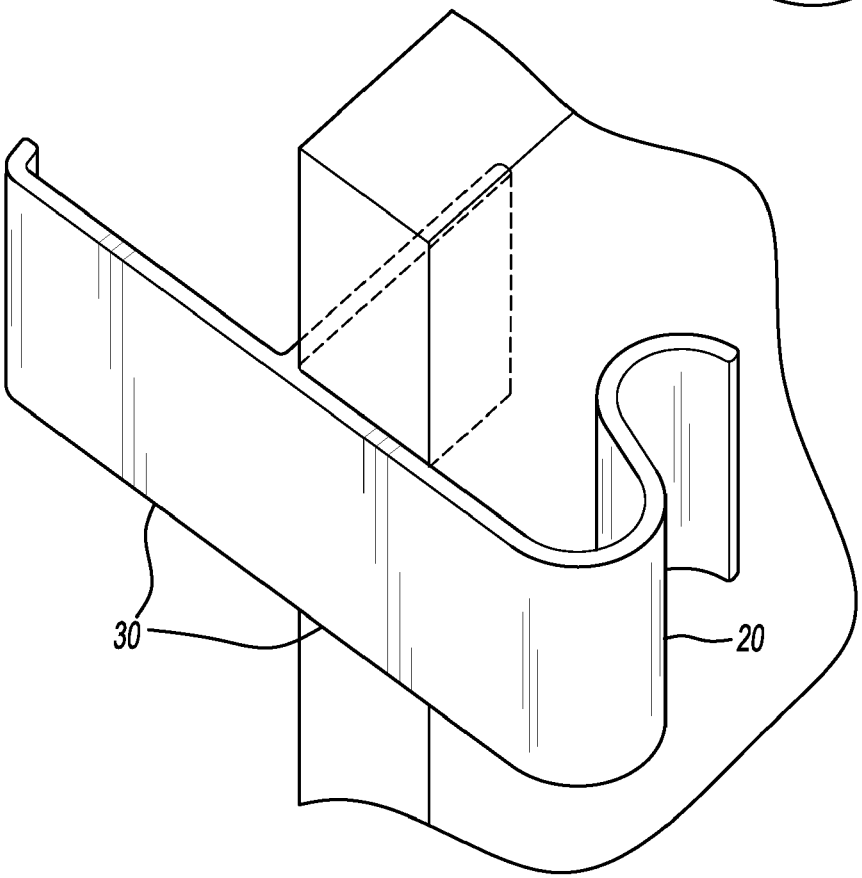
FIG. 12 is an illustration of the embodiment of the handle from FIGS. 9A-9C attached to a drawer.

FIGS. 11 and 12 are illustrative examples of the embodiments of FIGS. 9A-9C and 10A-10F as attached to a door, drawer or other panel structure. The curved first wall members of each embodiment are shown in contact with one side of the door, drawer, or other panel structure, while the third wall, shown in the figures as a substantially planar wall is in contact with an opposing side of the door, drawer, or other panel structure. The contact of the walls of the handle with the door, drawer, or other panel structure allows the handle to be held in place during use.

Figure 13A:
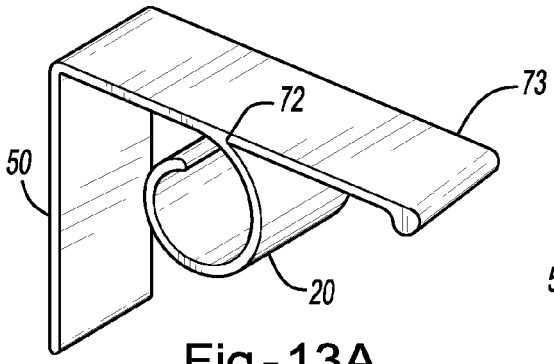
FIG. 13A is a perspective view of an embodiment of the handle in accordance with the present invention.
Figure 13B:
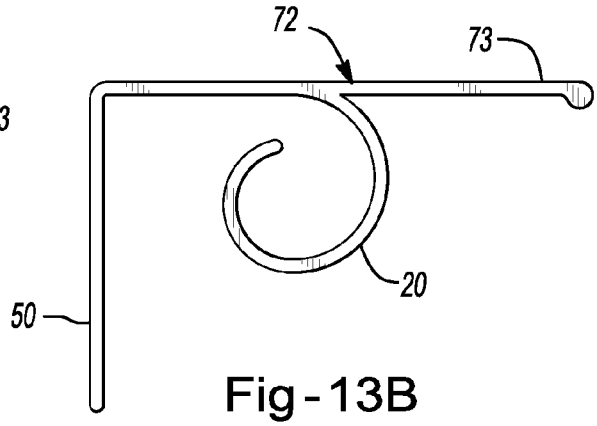
FIG. 13B is a profile view of the handle from FIG. 13A.

Referring to FIGS. 13A-B, the curved first wall member 20 may intersect the second wall member 30 at a midpoint 72 of the second wall member, such that the second wall member is substantially linear and extends toward the third wall member 50 and also away from the third wall member 50. The resulting tab structure 73 may be located on the exterior of a door, drawer, or other structure so that the tab structure 73 may be grasped during use. The portion of the second wall member 30 that extends toward the third wall member 50 may terminate at the third wall member or may continue beyond the point where the third wall member intersects the second wall member. The second wall member and third wall member may be arranged in a perpendicular relationship with one another. The second wall member and the third wall member may also be in a non-perpendicular arrangement. It is further possible that the portion of the second wall member that extends away from the third wall member may extend in a linear relationship with the portion of the second wall member that extends toward the third wall member. Alternatively, the portion of the second wall member that extends away from the third wall member may extend in a linear relationship with the portion of the second wall member that extends toward the third wall member. The relationship between the multiple portions of the second wall member may become non-linear at any point along the second wall member.

Figure 14A:
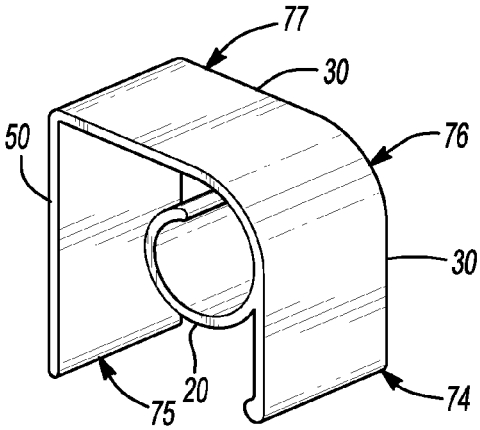
FIG. 14A is a perspective view of an embodiment of the handle in accordance with the present invention.
Figure 14B:
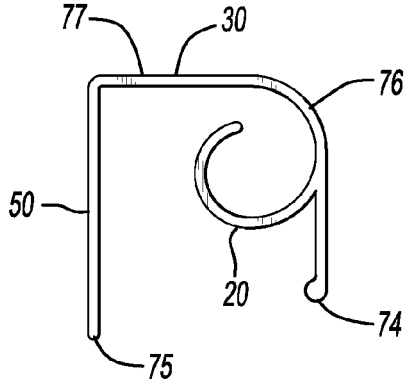
FIG. 14B is a profile view of the handle from FIG. 14A.

Referring to FIGS. 14A-B, an additional embodiment of the handle in accordance with the present teachings includes a second wall member 30 that may be partially coextensive with the curved first wall member 20. The resulting second wall member 30 includes a terminating end 74 that extends downward in the same direction as the terminating end 75 of the third wall member 50. The second wall member may further include a curved portion 76 extending away from the terminating end 74 that is coextensive with a portion of the curved first wall member. The second wall member may also include a linear portion 77 that extends to the location where the third wall member 50 intersects the second wall member 30. The second wall member and third wall member may or may not be arranged in a perpendicular manner relative to one another.

Figure 15A:
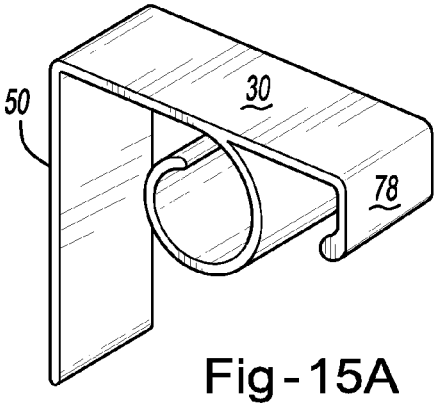
FIG. 15A is a perspective view of an embodiment of the handle in accordance with the present invention.
Figure 15B:
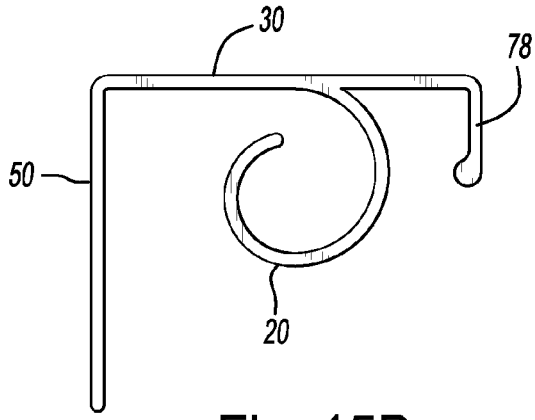
FIG. 15B is a profile view of the handle from FIG. 15A.

As shown (for example) in FIGS. 15A-B, the handle may include a fourth wall member 78. The fourth wall member 78 may extend from the second wall member 30. The fourth wall member 78 and third wall member 50 may intersect and thereby extend from the second wall member 30 at opposing ends of the second wall member. Both of the third and fourth wall members may extend from the second wall member at any location along the second wall member. In one embodiment, the third and fourth wall members both extend from opposing terminating ends of the second wall member. The fourth wall member may also extend upward from the second wall member or may extend both upward and downward from the second wall member.

Figure 16A:
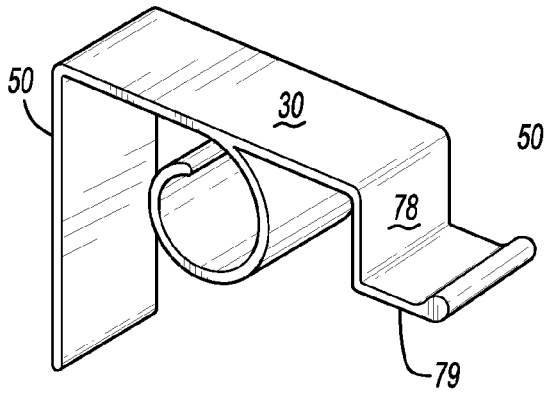
FIG. 16A is a perspective view of an embodiment of the handle in accordance with the present invention.
Figure 16B:
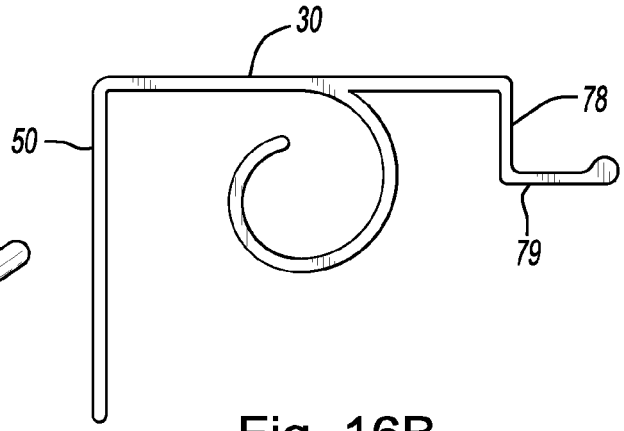
FIG. 16B is a profile view of the handle from FIG. 16A.

Referring to FIGS. 16A-B, a fifth wall member 79 may also be included. The fifth wall member 79 may extend from the fourth wall member 78 to serve as an additional tab structure for grasping the handle during use. The fifth wall member 79 may extend from the fourth wall member in a perpendicular arrangement as shown in FIGS. 16A-B. The fifth wall member may also extend in a generally upward direction so that an acute angle is formed between the fourth wall member and fifth wall member. The fifth wall member may also extend from any of the first, second, or third wall members.

Figure 17A:
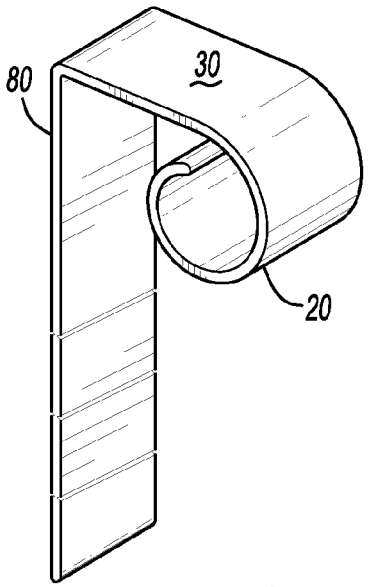
FIG. 17A is a perspective view of an embodiment of the handle in accordance with the present invention.
Figure 17B:
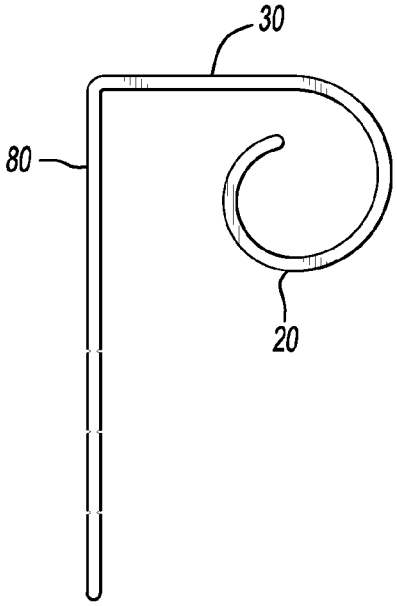
FIG. 17B is a profile view of the handle from FIG. 17A.

FIGS. 17A-B are an illustrative example of a handle having an elongated wall. The elongated wall 80 may be the third wall member as shown. The elongated wall 80 provides additional contact between the handle surfaces and the surface of a door, drawer or other surface during use. This increase in contact area may provide improved attachment strength by making the handle more difficult to remove and/or increasing the tension between the walls of the handle.

The wall members may all be of the same thickness, or the wall members may be of varying thicknesses. The wall members may be sufficiently thick so as to provide enough rigidity and strength to hold the handle in place on a door, drawer or other surface when in use. The wall members may also have a thickness that allows for sufficient flexibility so that the handle can be placed onto doors, drawers, and other surfaces of varying dimensions. The thickness of the wall members may be at least about 0.2 mm. The thickness of the wall member may be at least about 1.0 mm. Preferably, the thickness of the wall member may be at least about 1.5 mm. The length of each wall member may vary according to the dimensions of the surface that the handle will be placed upon during use. The length of each wall member may be at least about 8 mm. The length of each wall member may be at least about 20 mm. As shown in FIGS. 10A-F for example, the first and second wall members may be longer than the third wall member. As shown in FIGS. 17A-B for example, the third wall member may be longer than the first and second wall member. The width of the wall members may be of a sufficient width to allow for secure grasping of the handle during use. The width of the wall members may be the same for each wall member, or may vary with wall member having widths that differ from other wall members. For example, the width of the first wall member may be larger than the width of the remaining wall members, or the smaller than the width of the remaining wall members. The width of the second wall member may be greater than the width of the first and/or third wall member. The width of the wall members may be at least about 10 mm. The width of the wall members may be at least about 30 mm. Preferably, the width of the wall members is at least about 40 mm. Any curved wall member may have a radius that is at least about 5 mm. The radius of any curved wall member may be at least about 10 mm.

The dimensions of the handle may depend on the material composition of the handle. For example, a more flexible or brittle material may require additional thickness to provide the requisite rigidity for the handle. A more stiff material may require less thickness to allow for requisite flexibility.

The handle may be manufactured using a variety of materials and methods. The handle may include multiple materials or may be manufactured using one material. The material may include plastic, metal, fibrous material or any material that will not damage a drawer or door surface. The materials can be processed by injection molding (e.g., overmolding or two-shot injection molding), extrusion, compression molding or similar processing methods. The processing steps may produce a smooth surface or a rigged surface. The processing steps may result in a multi-layer surface such that a substantially rigid surface may be coated with a rigged soft-touch surface.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. Similarly, specific features or components described in the different embodiments of the blocks may be used with other embodiments or may be combined with yet other features or components to form other embodiments. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

What is claimed is:

1. A handle for opening and closing a door or drawer comprising:

a first wall member having a c-shape so that the first wail member can be grasped during installation, removal, and use;

a second wall member integral formed and extending from the first wall member, such that the second wall member intersects the first wall member at a location on the handle where the curvature of the first wall member ends;

a third wall member attached to and extending substantially perpendicular from the second wall member so that the third wall member is located on the inside of a door or drawer during use and is of sufficient length to maintain the handle in a fixed location during use;

wherein at least one wall member is generally flexible and resilient such that when the handle is attached to a door or a drawer the at least one wall member flexibly and resilient moves to form a self-grip in conjunction with the remaining wall members on a door or a drawer; and wherein the handle is substantially free of any wall intermediate the first wall member and the third wall member.

2. The handle of claim 1, wherein the second wall member further comprises an outer surface opposite and parallel to an inner surface, and the second wall member is substantially planar in shape.

3. The handle of claim 1, wherein the third wall member further comprises an outer surface opposite and parallel to an inner surface, and the third wall member is substantially planar in shape.

4. The handle of claim 1, wherein the third wall member is integrally formed with the second wall member.

5. The handle of claim 1, wherein the third wall members extend generally downward from the second wall member, each having a lowest downward location.

6. The handle of claim 5, wherein the lowest downward location of the third wall member does not extend downward beyond the lowest downward location of the first wall member.

7. The handle of claim 1, wherein the handle comprises a non-marring material.

8. The handle of claim 1, wherein the handle does not fasten to a door or a drawer by an adhesive, screw, nail, or staple.

9. The handle of claim 1, wherein the first wall member makes contact with a door or drawer at a point prior to a terminating end of the first wall member preventing the terminating end of the first wall member from coming into contact with the door or drawer.

10. A handle for opening and closing a door or drawer comprising:

a first wall member having a curved c-shape so that the first wall member can be grasped during installation, removal, and use;

a second wall member integral formed and extending from the first wall member, such that the second wall member intersects the first wall member at a location on the handle where the curvature of the first wall member ends;

a third wall member integrally formed with and extending substantially perpendicular from the second wall member so that the third wall member is located on the inside of a door or drawer during use and is of sufficient length to maintain the handle in a fixed location during use;

wherein the first wall member acts as both a gripping surface during use and also directly contacts an exterior of a door or drawer during use; and wherein at least one wall member is generally flexible and resilient such that when the handle is attached to a door or a drawer the at least one wall member flexibly and resilient moves to form a self-grip in conjunction with the remaining wall members on a door or a drawer.

11. The handle of clam 10, wherein the second wall member includes a portion that extends toward the third wall member and a portion that extends away from the third wall member.

12. The handle of claim 10, wherein said handle does not fasten to a door or a drawer by an adhesive, screw, nail, or staple.

13. The handle of claim 10, wherein the first wall member makes contact with a door or drawer at a point prior to a terminating end of the first wall member preventing the terminating end of the first wall member from coming into contact with the door or drawer.

14. The handle of claim 10, wherein, the handle is substantially free of any wall intermediate the first wall member and the third wall member.

* * * * *

UNITED STATES PATENT AND TRADEMARK OFFICE

CERTIFICATE OF CORRECTION

PATENT NO. : 8,365,360 B2
APPLICATION NO. : 12/536528
DATED : February 5, 2013
INVENTOR(S) : Dana L. Kunnath et al.

It is certified that error appears in the above-identified patent and that said Letters Patent is hereby corrected as shown below:

IN THE CLAIMS:

Column 8, Line 50, Claim 1, “wail” should be “wall”

Signed and Sealed this
Second Day of April, 2013

Teresa Stanek Rea
*Acting Director of the United States Patent and Trademark Office*